US005839652A

United States Patent [19]

Ben-Haim

[11] Patent Number: 5,839,652

[45] Date of Patent: Nov. 24, 1998

[54] BOX FOR FOOD PRODUCTS

[75] Inventor: Amit Ben-Haim, London, United Kingdom

[73] Assignee: Fold-Pak Europe Limited, Great Britain

[21] Appl. No.: 765,999

[22] PCT Filed: Jul. 18, 1995

[86] PCT No.: PCT/GB95/01695

§ 371 Date: Mar. 27, 1997

§ 102(e) Date: Mar. 27, 1997

[87] PCT Pub. No.: WO96/02426

PCT Pub. Date: Feb. 1, 1996

[30] Foreign Application Priority Data

Jul. 18, 1994 [GB] United Kingdom ..... 9414445.8

[51] Int. Cl.[6] ..... B65D 5/54

[52] U.S. Cl. ..... 229/240; 229/114; 229/186; 229/903; 229/906

[58] Field of Search ..... 229/114, 120, 229/186, 240, 903, 906

[56] References Cited

U.S. PATENT DOCUMENTS

| | | | |
|---|---|---|---|
| 3,146,934 | 9/1964 | Steiger | 229/186 |
| 3,249,282 | 5/1966 | Kuehn, Jr. | 229/186 |
| 3,679,048 | 7/1972 | Fujio . | |
| 3,983,256 | 9/1976 | Norris et al. . | |
| 4,183,458 | 1/1980 | Meyers . | |
| 4,287,998 | 9/1981 | Zimmermann . | |
| 4,291,806 | 9/1981 | Austin . | |
| 4,361,236 | 11/1982 | Lavery . | |
| 4,538,732 | 9/1985 | Kuchenbecker . | |
| 4,567,341 | 1/1986 | Brown . | |
| 4,592,914 | 6/1986 | Kuchenbecker . | |
| 4,809,907 | 3/1989 | Langer . | |
| 4,821,492 | 4/1989 | Prater . | |
| 4,836,383 | 6/1989 | Gordon et al. . | |
| 4,871,071 | 10/1989 | Zimmermann | 229/120 |
| 4,919,785 | 4/1990 | Willey et al. | 229/207 |
| 4,930,639 | 6/1990 | Rigby | 229/120 |
| 4,951,868 | 8/1990 | Mode | 229/186 |
| 5,009,320 | 4/1991 | Kramer . | |
| 5,053,594 | 10/1991 | Thota et al. . | |
| 5,076,439 | 12/1991 | Kuchenbecker | 229/207 |
| 5,242,106 | 9/1993 | Gulliver . | |
| 5,244,145 | 9/1993 | Forbes, Jr. . | |
| 5,253,801 | 10/1993 | Bernstein et al. . | |
| 5,265,796 | 11/1993 | Gulliver et al. . | |
| 5,267,686 | 12/1993 | Gulliver et al. . | |
| 5,326,022 | 7/1994 | Green | 229/120 |
| 5,330,099 | 7/1994 | Beales et al. | 229/207 |
| 5,358,176 | 10/1994 | Rigby | 229/240 |

FOREIGN PATENT DOCUMENTS

| | | | |
|---|---|---|---|
| 0267171 | 10/1987 | European Pat. Off. . | |
| 0334252 | 9/1989 | European Pat. Off. . | |
| 0499727A1 | 2/1991 | European Pat. Off. . | |
| 0455610A1 | 4/1991 | European Pat. Off. . | |
| 505925 | 9/1992 | European Pat. Off. | 229/240 |
| 1240488 | 7/1960 | France . | |
| 0505925A1 | 3/1992 | Germany . | |
| 0560223A1 | 3/1993 | Germany . | |
| 0574744A1 | 5/1993 | Germany . | |
| 616435 | 8/1946 | United Kingdom . | |
| 990150 | 12/1963 | United Kingdom . | |
| 1584147 | 8/1976 | United Kingdom . | |
| 2041884 | 1/1980 | United Kingdom . | |
| 2232566 | 12/1989 | United Kingdom . | |
| 2273092 | 1/1992 | United Kingdom . | |
| 2264697 | 3/1993 | United Kingdom . | |
| WO88/02338 | 4/1988 | WIPO . | |
| WO90/02699 | 3/1990 | WIPO . | |
| WO90/15514 | 12/1990 | WIPO . | |
| WO93/10009 | 5/1993 | WIPO . | |
| WO94/10045 | 11/1994 | WIPO . | |

*Primary Examiner*—Gary E. Elkins
*Attorney, Agent, or Firm*—Foley & Lardner

[57] ABSTRACT

A microwavable box constructed from a blank, having a box base forming area (12), two pairs of opposing side sections (14) and (16) each with a collapsible web (18) between them, flaps (26) extending from each of the three sides and a lid (28) which includes a tear-off strip (30) to enable the escape of gases from the box and the opening of the lid.

6 Claims, 2 Drawing Sheets

BOX FOR FOOD PRODUCTS

This invention concerns boxed, especially boxes for food products which can be cooked in the box in a microwave oven or in a gas or electric oven.

Boxes for food items to be cooled by microwave or in gas or electric ovens are known, which have a lid formed by overlapping flaps extending from each side of the box, two of the flaps being interengeable by means of a tab on one flap that passes through and is retained by a slot in the opposing flap. Such boxes are not entirely satisfactory because the lid cannot be effectively sealed once the food product has been put into the box.

An object of this invention is to provide an improved box, especially suitable for food items which are to be cooked by microwave radiation.

According to this invention there is provided a box for food products suitable for microwaving comprising:

a base;

side walls extending upwards from the base and being continuous around corners of the box;

a lid extending from one side wall;

flaps extending from each of the other side walls; wherein in an erected and sealed box the flaps are folded inwards firstly and the lid is adhered to said flaps around its periphery, the lid having a line of weakness, whereby a major portion of the lid can be opened, characterised in that the lid is provided with a tear-off strip which upon removal allows gases to escape from the box during the heating of the contents thereof whilst the rest of the lid remains secured to the flaps.

The corners of the box are preferably formed by webs bridging adjacent sides of the box. The webs preferably have fold lines where they meet a side of the box and an intermediate fold line, whereby the parts of the web formed by the intermediate fold line may be collapsed against each other as the adjacent sides of the box are drawn together and the collapsed web folded over one side or other of the box and fixed preferably with hot melt adhesive. In this way, there are no joins at corners of the box through which food or liquid can escape or contamination enter. This is particularly important for food items which include a gravy, sauce or the like, so that spillage does not occur during the cooking process or when the box is being transported before or after cooking.

The lid having a tear off strip near its leading edge, when removed firstly allows steam to escape during the process but leaves the majority of the lid in place to prevent splashing of the cooking materials during cooking and secondly allows the lid to be lifted and separated from the box flaps, after cooking is completed for removal of the contents of the box is possible.

Removal of the tear-off strip may be achieved by means of two parallel perforated lines running near to the leading edge of the lid.

Each folded flap preferably extends substantially midway across the opening of the box to reduce leakages therefrom. The lid may be adhered to the flaps by hot melt adhesive.

The box may be wrapped in a clear wrapper. Preferably, the wrapper is of a heat shrinkable plastics materials.

This invention will now be further described, by way of example only, with reference to the accompanying drawings, in which.

Figure 1:
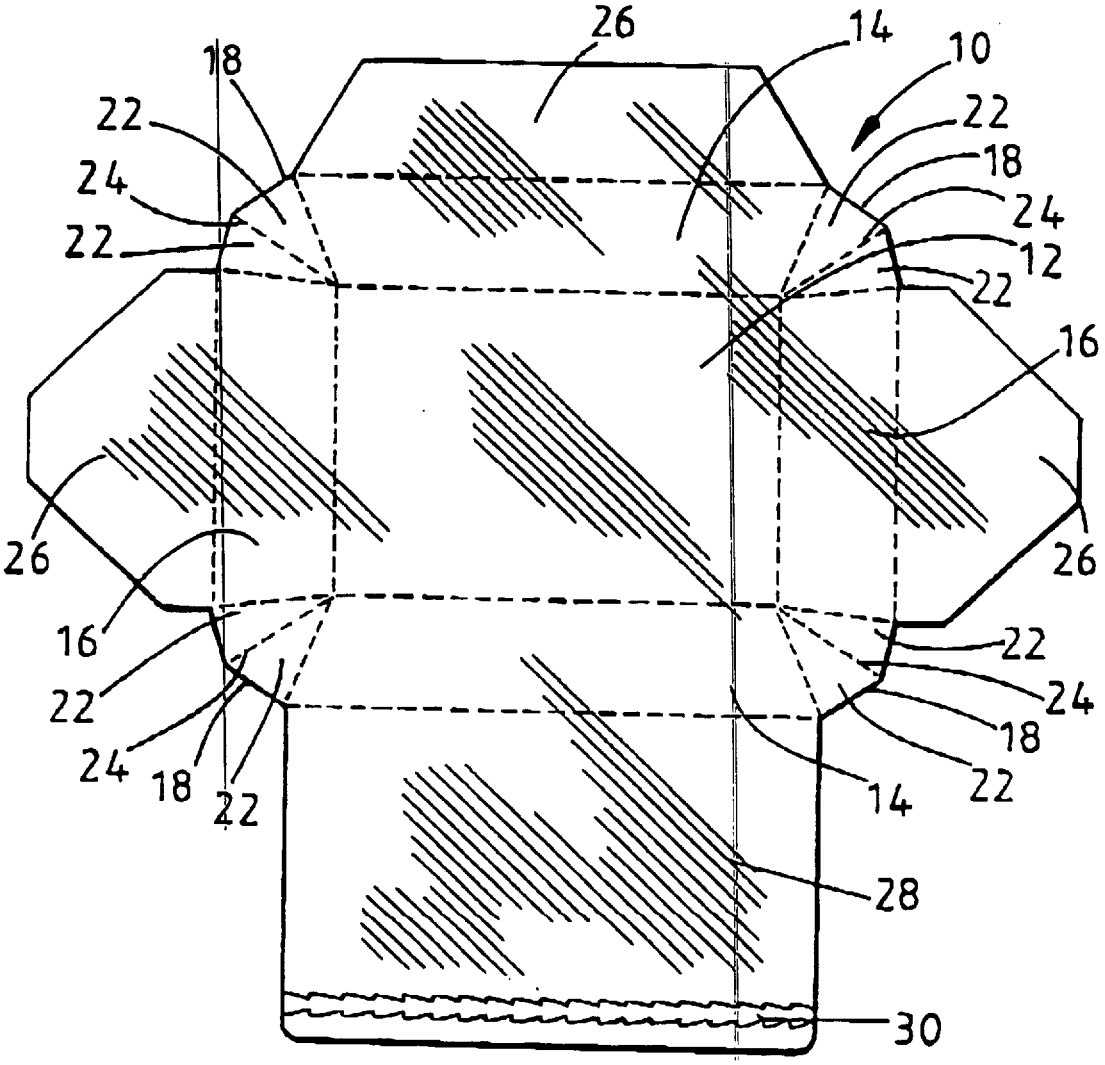
FIG. 1 shows a blank for a box.

Referring to FIG. 1 of the accompanying drawings, a blank 10 for a microwavable box 20 (see FIGS. 2 and 3) is cut from cardboard sheet and the blank is creased where marked with broken lines, so that it can be folded and erected into a box. The blank 10 has a box base forming area 12 bounded by two pairs of opposing side forming sections 14 and 16. Between each adjacent side forming section is a web 18. Each web comprises a pair of triangular sections 22 with a common side 24. Extending from each of three sides are flaps 26 and from the other side a lid 28. The lid 28 includes a tear-off strip 30 which is removable to open the lid.

Figure 2:
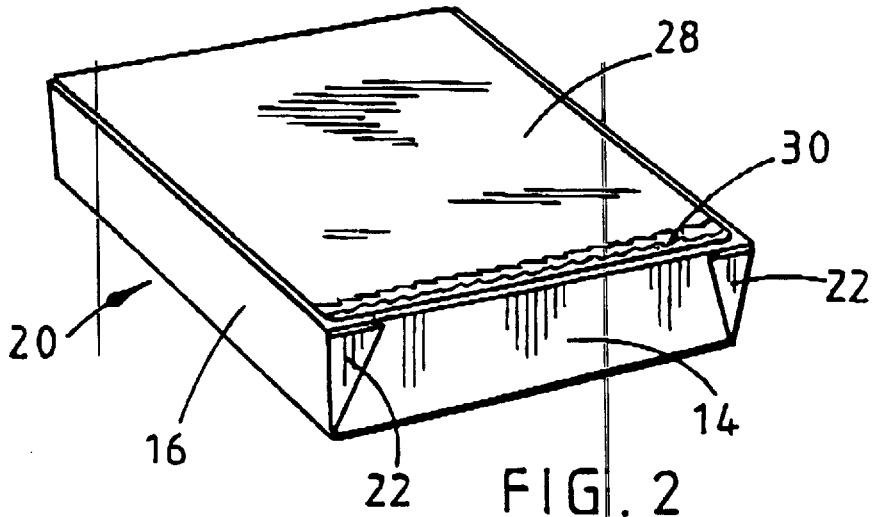
FIG. 2 shows the erected end sealed box.
Figure 3:
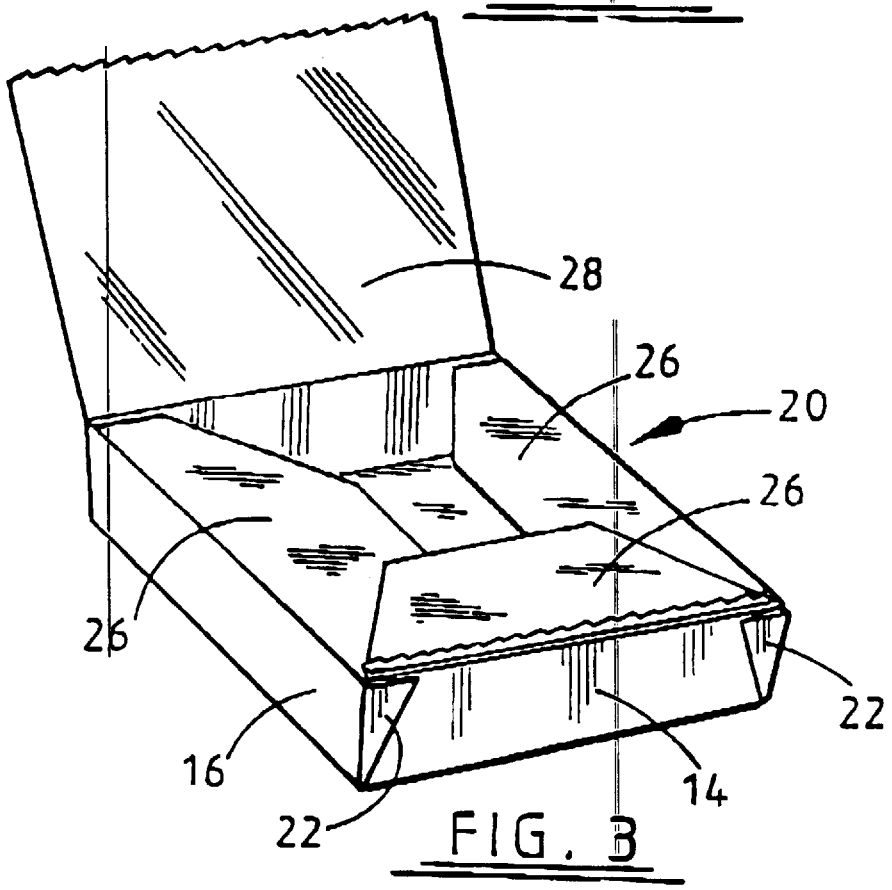
FIG. 3 shows a box opened.

To form the box, the sides are folded up, so that the two triangular sections 22 of each web 18 collapse outwards against each other and the collapsed webs are adhered together using hot melt adhesive and folded along a side of the box and adhered thereto again with hot melt adhesive. As shown the webs are folded over the front side 14 of the box but they may alternatively be folded backwards over the sides 16 of the box. The box can then be filled and the flaps 26 folded over before the lid is adhered to the flaps by a strip of hot melt adhesive around a periphery of the lid. Finally, the box can be wrapped with a clear wrapper, which is preferably of heat shrinkable plastics material. The erected box is shown in FIGS. 2 and 3 of the drawings.

The box will usually be filled with a food item, which is to be cooked by microwave radiation. The box may be suitable for keeping chilled or frozen food.

When the food is to be cooked, the tear-off strip 20 is removed, so that steam can escape from the box during the cooking process. The rest of the lid remains in place and prevents splashing of contents from the box. After the food has been cooked, the lid can be prised open and the flaps opened outwards for removal of the food from the box.

What is claimed is:

1. A box (20) for food products suitable for microwaving comprising:

a base (12);

side walls (14, 16) extending upwards from the base and being continuous around corners of the box, the side walls including a first side wall and other side walls;

a lid (28) extending from the first side wall, the lid having a periphery;

flaps (26) extending from each of the other side walls; wherein said box is erected and sealed and the flaps (26) are folded inwards firstly and the lid (28) is adhered to said flaps around the periphery, the lid (28) having a line of weakness whereby a major portion of the lid (28) can be opened, characterized in that the lid (28) is provided with a tear-off strip (30) which upon removal allows gases to escape from the box during heating whilst the lid remains secured to the flaps (26); and the box including an opening defined by the area between the side walls proximate the folded flaps, wherein each folded flap (26) extends substantially midway across the opening of the box to reduce leakages therefrom.

2. A box as claimed in claim 1, wherein corners of the box are formed by webs (18) bridging adjacent sides of the box.

3. A box as claimed in claim 2, wherein each web has fold lines where they meet each respective side wall and an intermediate fold line defining two parts of the web, whereby the parts (22) of each web are collapsible against each other as the adjacent sides of the box are drawn together and the collapsed web is foldable over one of the adjacent sides of the box.

4. A box as claimed in claim 3, wherein the collapsed web (18) is fixed with hot melt adhesive.

5. A box as claimed in claim 1, wherein the lid includes a leading edge, the removal of the tear-off strip (30) is achieved by means of two parallel perforated lines running near to the leading edge of the lid.

6. A box as claimed in claim 1, wherein the lid is adhered to the flaps by hot melt adhesive.

* * * * *